US005157216A

United States Patent [19]

Chafe

[11] Patent Number: 5,157,216

[45] Date of Patent: Oct. 20, 1992

[54] MUSICAL SYNTHESIZER SYSTEM AND METHOD USING PULSED NOISE FOR SIMULATING THE NOISE COMPONENT OF MUSICAL TONES

[75] Inventor: Christopher D. Chafe, Palo Alto, Calif.

[73] Assignee: The Board of Trustees of the Leland Stanford Junior University, Stanford, Calif.

[21] Appl. No.: 464,993

[22] Filed: Jan. 16, 1990

[51] Int. Cl.[5] ..... G10H 1/057; G10H 1/08; G10H 5/10

[52] U.S. Cl. ..... 84/695; 84/697; 84/702; 84/DIG. 10; 84/DIG. 23; 331/78

[58] Field of Search ..... 84/625-627, 84/630, 631, 660, 662-664, 695, 697, 698, 702, 703, 707, 708, 735-738, DIG. 4, DIG. 12, DIG. 23, DIG. 26, DIG. 10; 331/78; 381/51, 60, 63, 118

[56] References Cited

U.S. PATENT DOCUMENTS 4,296,384 10/1981 Mishima ..... 331/78
4,408,512 10/1983 Mishima ..... 74/DIG. 12
4,736,663 4/1988 Wawrzynek et al. ..... 331/78 X

OTHER PUBLICATIONS

M. E. McIntyre, "Aperiodicity in Bow-String Motion", *Acustica*, vol. 49, No. 1, pp. 13-32 (1981).

M. E. McIntyre, R. T. Schumacher, J. Woodhouse, "On the Oscillations of Musical Instruments", *J. Acoust. Soc. Am.* 74(5), pp. 1325-1345, Nov. 1983.

*Primary Examiner*—Stanley J. Witkowski
*Attorney, Agent, or Firm*—Flehr, Hohbach, Test, Albritton & Herbert

[57] ABSTRACT

A music synthesizer simulates the musical tones of bowed string and wind instruments. The synthesizer includes a noise generator which generates pulsed noise signals, as well as a resonant system or signal generator which generates deterministic or periodic signals. In one embodiment, the pulsed noise signals are combined with the periodic signals to generate an improved synthesized musical sound. In another embodiment, pulsed noise is added to an excitation signal for energizing a resonating system, which may or may not be dynamically coupled to the excitation generator, resulting in the generation of synthesized sound having appropriate noise characteristics for bowed string and wind instruments.

9 Claims, 5 Drawing Sheets

MUSICAL SYNTHESIZER SYSTEM AND METHOD USING PULSED NOISE FOR SIMULATING THE NOISE COMPONENT OF MUSICAL TONES

The present invention relates generally to electronic musical synthesizers, such as musical synthesizers which mimic the sound of acoustic violins, and more particularly to a new system and method for generating the noise components of synthesized musical tones.

BACKGROUND OF THE INVENTION

Musical tones from acoustic bowed string and wind instruments, though nearly periodic, have a noise component that is a subtle but crucial part of the sound. Prior art attempts to simulate these instruments in digital electronic synthesizers have been deficient with regard to the exact quality of the noise component.

The present invention is based on a new description or model of the noise generation mechanism in bowed string and wind instruments (including brass and voice) which accounts for some of the noise present in self-sustained mechanical oscillators (i.e., non-percussive acoustical musical instruments). Analyses by the inventor have verified the existence of the noise predicted by this new model, and digital simulations using the present invention have synthesized tones with improved bow and breath noise. The present invention is particularly applicable to bowed string instruments such as the violin, cello, and bass, and to wind instruments such as the clarinet, oboe, flute, trumpet, trombone and the human voice.

The precise quality of the noise generated when synthesizing the tones of bowed strings and wind instruments is important in achieving an improved sound synthesis capability. Mixing in spectrally shaped Gaussian noise has not proved sufficient. There is no perceptual fusion of the noise and periodic sounds, and the listener hears two sources. A subjective impression from the best attempts to mix in spectrally shaped Gaussian noise is that the noise is "not well-incorporated." Though this is not a common evaluation in acoustic parlance, the meaning of this subjective analysis will become evident from the following description of the present invention.

SUMMARY OF THE INVENTION

In summary, the present invention is a music synthesizer which simulates the musical tones of bowed string and wind instruments. The synthesizer includes a noise generator which generates pulsed noise signals, as well as a resonant signal generator which generates deterministic or periodic signals. In one embodiment, the pulsed noise signals are combined with the periodic signals to generate an improved synthesized musical sound. In another embodiment, pulsed noise is added to an excitation signal for energizing a resonating system, which results in the generation of synthesized sound having appropriate noise characteristics for bowed string and wind instruments.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

The following is a brief explanation of how the theory of operation of the present invention works. While this theory helps to explain how the invention works, it should be understood, however, that this theory of operation forms no part of the present invention.

The present invention is based on an improved physical model of bowed string and wind instruments and the physical process by which these instruments generate sound. In particular, this physical model is a model of the nonsinusoidal aspects of bowed string (e.g., violin) and wind instrument sounds.

It is the inventor's theory that when a bow is pulled over a violin string it "sticks and slips" in a periodic or pulsed fashion. There is no noise generated while the bow sticks, and therefore the nature of the noise from the bow is pulsed. Mathematically, the contribution of energy SV(t) by the bow to the string, as a function of time (t) can be defined as a nonlinear function which mimics the behavior of a bow:

$$SV(t) = \begin{cases} H(BV, BP, SV_{hist}) \text{ if } BV - SV_{hist} \geqq BP + 1 \\ BV - SV_{hist} \text{ otherwise} \end{cases} \quad \text{(Eq. 1)}$$

where BV is the bow velocity, BP is the bow pressure, and $SV_{hist}$ which is the energy reflected by the instrument back to the point of excitation. H is a function of these three variables which characterizes slipping friction. Thus, the first portion of this non-linear function (where $BV - SV_{hist} \geqq BP + 1$) is the "slip" portion of the function, while the other portion is the "stick" portion of the function. The string, at first stuck to the bow, is pulled from its resting position until its restoring force overcomes the sticking friction, which is governed by BP, the bow's downward force on the string. The string then releases from the bow, flying back to the point where it is recaptured and another cycle begins. The rapid flyback motion generates an impulse which propagates down the string and will provoke the next release one period later (i.e., the time interval of a round trip on the string).

Figure 1:
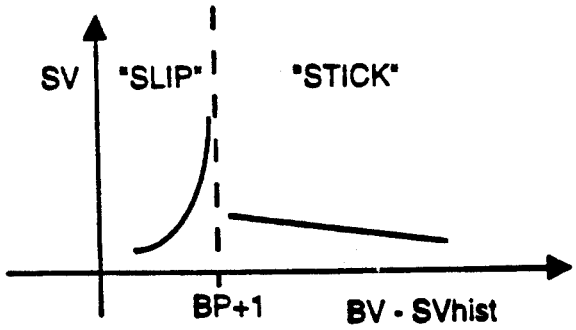
FIG. 1 depicts a non-linear excitation function for simulating the sound of a bowed string instrument.

A plot of a typical implementation of the non-linear SV(t) function of Equation 1 is shown in FIG. 1.

The reed of a wind instrument, such as a clarinet, has similar characteristics. The reed tends to let air through in micro-bursts, with the timing of the bursts being related to the frequency of the sounds which are resonating inside the instrument. This mode of operation also applies to other types of wind instruments, such as flutes, in that the sounds resonating inside the instrument affect the inflow of air in a pulse like fashion related to the frequency of the sounds which are resonating inside the instrument.

To verify the stick and slip model, it was decided to use a recently devised sound analysis package, based on a model which divides sounds into deterministic (i.e., periodic) and residual components. The sound generated by a cello was analyzed by separating the sinusoidal components of the sound from the noise or non-deterministic components. This analysis was performed by tracking observable sound partials through a series of fast Fourier Transforms (FFT) frames, building up a record of their frequency, amplitude and phase fluctuations. The signal is then regenerated by a bank of sinusoidal oscillators driven by the analyzed data. When the resulting, noiseless signal is subtracted from the original recorded sound, the resulting signal is the residual or noise components of the original sound. See X.J. Serra, "Sound Decomposition System based on a Deterministic Plus Residual Model," Ph.D. Dissertation, Dept. of Music Rep. STAN-M58, Stanford University, 1989.

Figure 2:
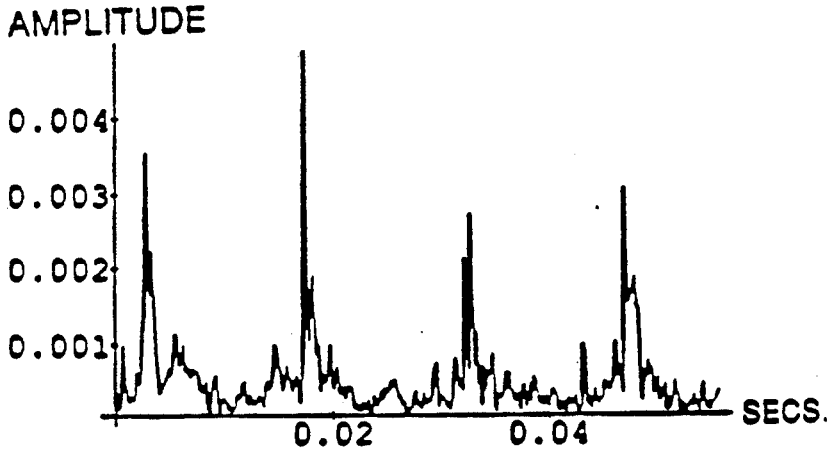
FIGS. 2 and 3 depict the waveforms of noise pulses extracted from a cello playing its open "C" string.

FIG. 2 depicts the noise waveform extracted from a cello playing its open "C" string, which plays at a pitch of 65 Hz, using the noise extraction method just described. FIG. 2 shows the existence of the predicted noise pulses. In this FIGURE, the position of the bow was very close to the bridge, with the ratio of the bow-bridge distance to string length being equal to approximately 0.02.

Figure 3:
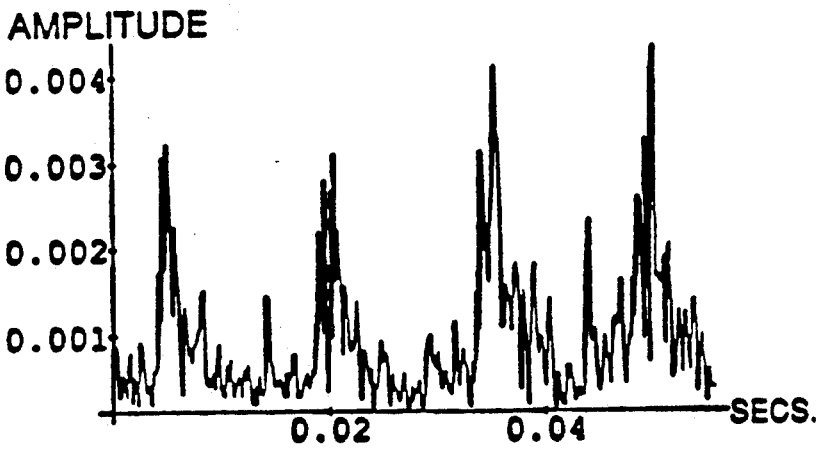

FIG. 3 depicts the noise waveform extracted from a cello playing its open "C" string, with the bow located farther from the bridge, with the ratio of the bow-bridge distance to string length being equal to approximately 0.11. The sounds generated with this bow position are less strident than those in the bow position of FIG. 2. Note that the width of the noise pulses in FIG. 3 are wider than those in FIG. 2. This shows that the duty cycle of the noise pulses is correlated with the audible quality of the sounds generated.

Figure 4:
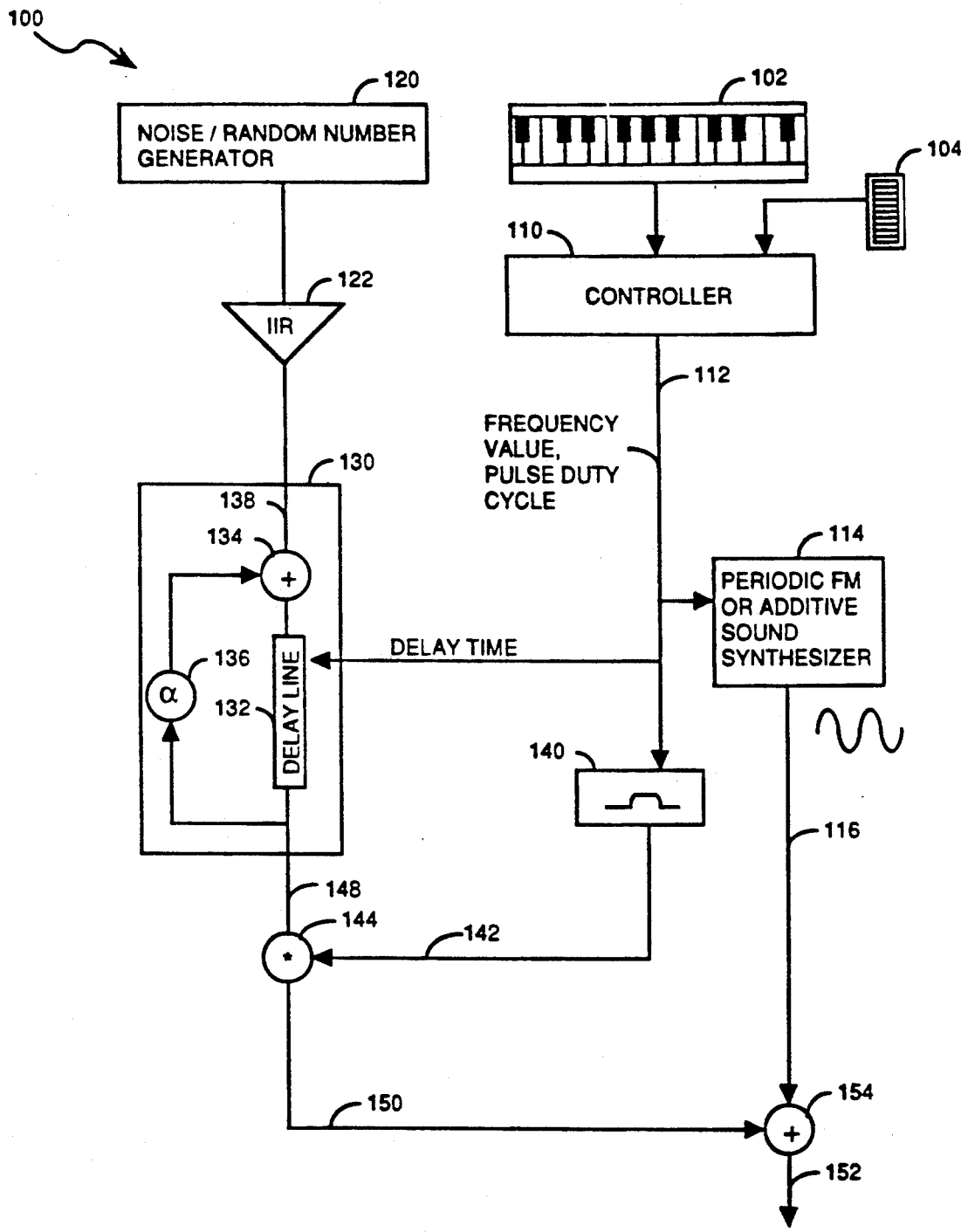
FIG. 4 is a block diagram of a musical synthesizer incorporating a first preferred embodiment of the present invention.

Referring to FIG. 4, there is shown a musical synthesizer 100 incorporating a first preferred embodiment of the present invention. This FIGURE represents one voice of a multi-voice synthesizer, including a conventional electronic keyboard 102 and vibrato thumb wheel 104 which are coupled to a controller 110. In a conventional synthesizer, the controller 110 is an electronic interface that outputs a stream of frequency values, depending on the keyboard note which has been depressed and the desired amount of vibrato, and velocity values corresponding to the loudness of each note. These numerical values are then transmitted on line 112 to a conventional FM or additive sound synthesizer 114, such as the DX7 musical synthesizer made by Yamaha. In the present system 100, the musical synthesizer 114 generates the deterministic or periodic portions of a synthesized sound signal, which is output on line 116.

The synthesizer 100 also includes a digital noise generator 120, which is typically a random number generator. The digital signals output by the noise generator 120 are filtered by a pre-emphasis filter 122. In the preferred embodiment, filter 122 is a conventional two-pole IIR filter that boosts the high frequency components of the noise.

Next, the noise signal output by the IIR filter 122 is "colored" by a comb filter 130. A comb filter 130 is a delay line 132 with a feedback path. Thus the input to the comb filter is delayed by delay line 132 for a specified delay period. A portion of the output from the delay line 132 is feed back and combined with the input signal by adder 134. Scaling element 136 determines the portion of the delay line output which is combined with the input signal on line 138.

The delay time of the delay line 132 is specified by the controller 110. Typically, the delay time is inversely proportional to the frequency of the fundamental tone being synthesized.

A pulse generator 140 generates pulses at a frequency equal or corresponding to the frequency value generated by the controller 110 and transmitted on line 112. The duty cycle or width of the pulses generated by the pulse generator 140 is controlled by a pulse duty cycle parameter that is also generated by the controller. The pulses output by the pulse generator 140 on line 142 control a gate 144, which gates the noise signal output by comb filter 130 on line 148. The combined operation of the pulse generator 140, and comb filter 130 is to generate a pulsed and colored noise signal on line 150, with a pulse cycle that is related to the frequency of the deterministic signal generated by synthesizer 114.

The final output signal on line 152 is generated by an adder 154 which combines the pulsed noise signal on line 150 with the deterministic signal on line 116.

Figure 5:
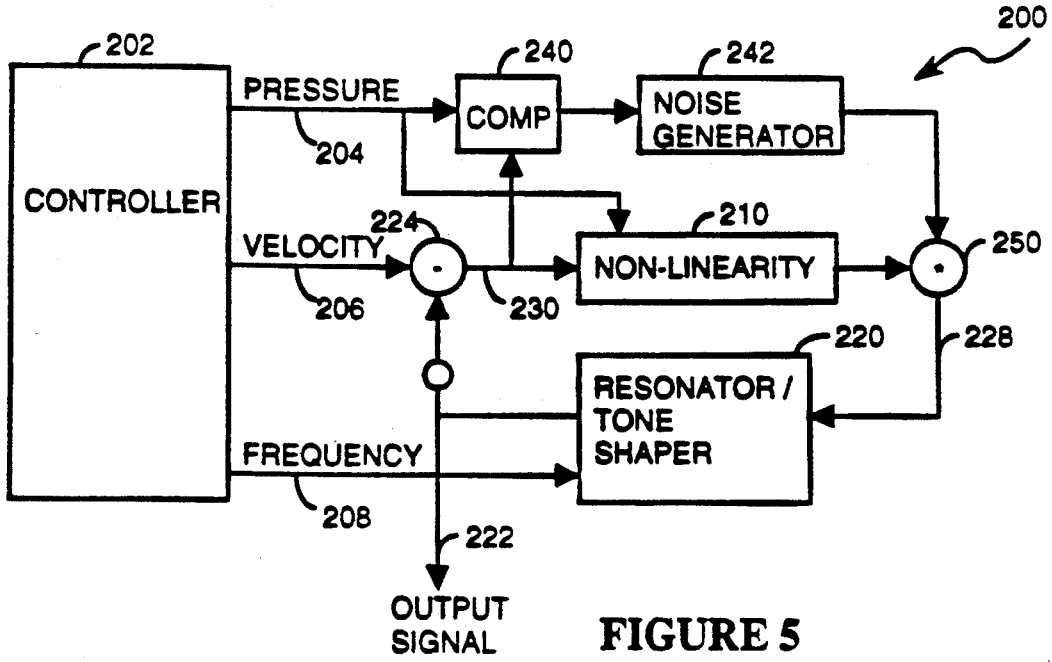
FIG. 5 is a block diagram of a musical synthesizer incorporating a second preferred embodiment of the present invention.

Referring to FIG. 5, there is shown one voice synthesizer 200 of a multi-voice musical synthesizer system, incorporating a second preferred embodiment of the present invention. This synthesizer 200 includes a controller 202, which will typically be driven by an electronic keyboard (not shown) and other conventional input devices such as a foot pedal and a vibrato thumb wheel (also not shown). The controller 202 generates a pressure parameter on line 204, a velocity parameter on line 206, and a frequency value on line 208. The pressure and velocity parameters function as an external energy source.

In this synthesizer 200, the pressure and velocity parameters (i.e., control signals) are first processed by a non-linear element 210, and the resulting signal is used to drive an audio-frequency resonator or tone shaper 220. The frequency response of the audio resonator or tone shaper 220 is controlled by the frequency value received on line 208. The output of the resonator 220 on line 222 is then either recorded, or used to drive an audio speaker (not shown). An example of a non-linear function suitable for use as the non-linearity 210 is shown in FIG. 1.

As shown in FIG. 5, a portion of the output of the resonator 220 is subtracted from the excitation signal by a subtraction element 224. The resulting feedback signal on line 230 is then used as the input to the non-linearity 210.

The above described synthesizer generates deterministic waveforms. To add noise in accordance with the present invention, the feedback signal on line 230 is compared by comparator 240 with the pressure parameter on line 204. This pressure parameter will typically be a threshold value that separates two portions of the non-linear function associated with non-linearity element 210. See, for example, the non-linear function shown in FIG. 1. Using the "slip and stick" model, when the feedback signal is in the "slip" range (i.e., the feedback signal is on a first side of the threshold value), the comparator 240 enables the operation of a noise generator 242. When the feedback signal is in the "stick" range (i.e., on the other side of the threshold value), the comparator 240 disables the operation of the noise generator 242. The pulse width of the noise signal is governed by the dynamic interaction of the non-linearity 210 and the resonator 220. Thus, in this embodiment of the invention, the noise pulse width is automatically controlled by the characteristics of these components and does not require a separate control parameter.

When the noise generator 242 is enabled, it generates a noise signal that is then combined by multiplier element 250 with the output of the non-linear element 210. When the noise generator 242 is disabled, it outputs a value of "1" so that the multiplier element 250 passes the output of the non-linear element 210 unchanged. Note that comparator 240 is equivalent in function to the gate 144 in FIG. 4 in that it pulses the noise signal from a noise generator.

In one preferred embodiment the noise generator 242 works as follows. Equation 1 above defines the operation of the non-linearity 210. Adding noise to this non-linearity entails a modification of the slipping portion of the function. In Equation 2 below, the slipping output is perturbed by a noise function N(x). Its noise term, u(n) in Equation 3, is non-negative uniform noise which varies in value between 0 and 1. The slipping force is multiplied by noise that is offset by an offset factor 0 and scaled by a gain factor G. The coarseness of N(x) is governed by a parameter P, which controls the percentage of samples that will be perturbed by randomly controlling the frequency of noise sample inclusion.

$$SV(t) = \begin{cases} N\{H(BV, BP, SV_{hist})\} \text{ if } BV - SV_{hist} \geqq BP + 1 \\ BV - SV_{hist} \text{ otherwise} \end{cases} \quad \text{(Eq. 2)}$$

$$N(x) = \begin{cases} x * (O + Gu(n)) \text{ if } u(n) > P \\ x \text{ otherwise} \end{cases} \quad \text{(Eq. 3)}$$

Thus, in FIG. 5, the output of the noise generator 242 is equal to (O+Gu(n)) when the excitation signal on line 230 is in the "slip" range, and "1" otherwise. FIGS. 6–9 show the effect of incorporating noise during the sustained portion of a cello simulation and during the starting transient of a clarinet simulation. The noise generator 242 in these simulations is characterized by the following parameter values: an offset, 0=0.05; a gain, G=4.0; and a coarseness parameter, P=0.5. Thus, random noise will be added to half of the digital samples during "slip" time periods. More particularly, half of the output samples generated by the non-linear element 210 will be multiplied by a random factor which varies between 2.05 and 4.05 during "slip" time periods.

Figure 6:
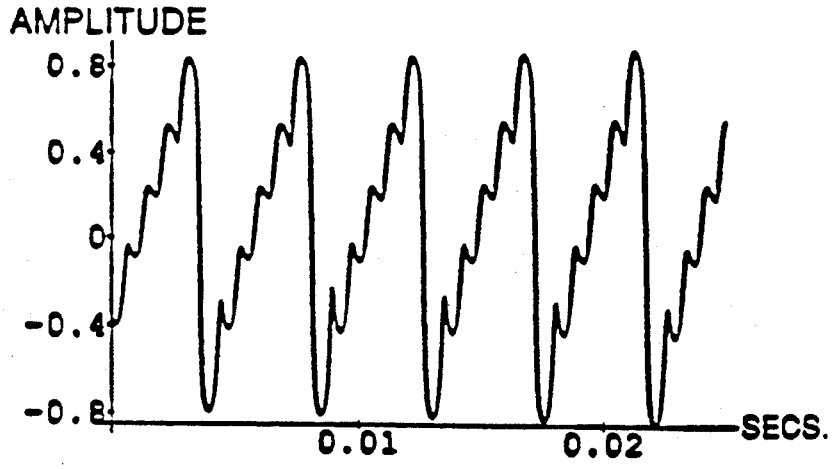
FIG. 6 depicts the waveform of a simulated cello tone at 220 Hz.
Figure 7:
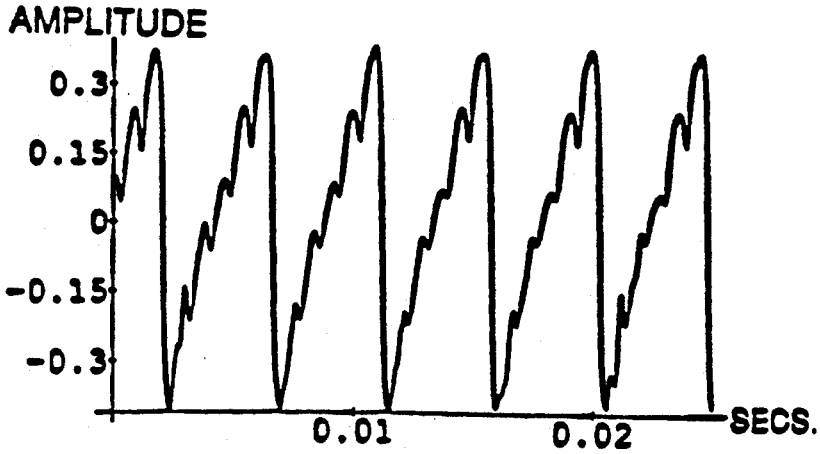
FIG. 7 depicts the waveform of a simulated cello tone at 220 Hz after the incorporation of noise generated in accordance with the present invention.

FIG. 6 depicts the waveform of the sustained period of a simulated cello tone at 220 Hz, and FIG. 7 depicts the waveform of a simulated cello tone at 220 Hz after the incorporation of noise generated in accordance with the embodiment of the present invention shown in FIG. 5. The noise is most noticeable in FIG. 7 as instabilities in waveform "crumples".

Figure 8:
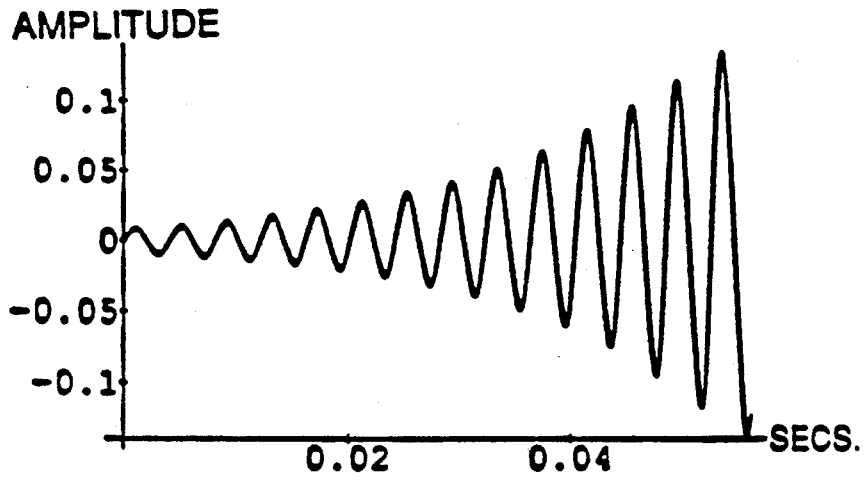
FIG. 8 depicts the waveform of a simulated clarinet tone at 220 Hz.
Figure 9:
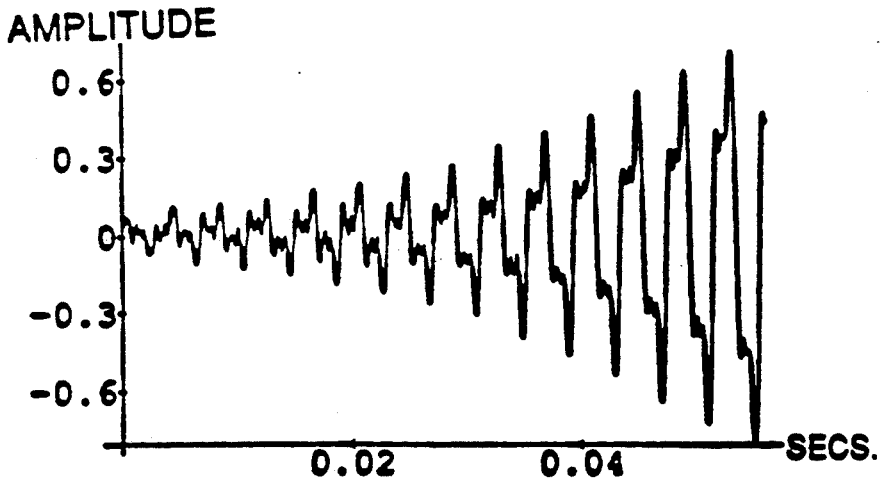
FIG. 9 depicts the waveform of a simulated clarinet tone at 220 Hz after the incorporation of noise generated in accordance with the present invention.

FIG. 8 depicts the waveform of a starting transient for a simulated clarinet tone at 220 Hz, and FIG. 9 depicts the waveform of a starting transient for a simulated clarinet tone at 220 Hz after the incorporation of noise generated in accordance with the embodiment of the present invention shown in FIG. 5.

It is known that traces of subharmonics are often present in musical tones and are detectable using discrete Fourier Transforms. However, subharmonics have been absent from previous simulations of sustained bowed string tones. After starting transients have died out and the system stabilizes, periodicity is quite exact. Using discrete Fourier Transforms to analyze synthesized musical sounds, synthesized musical sounds with and without the pulsed noise of the present invention were compared for subharmonic features. The result is that bow noise generated with the above described method also generates sustained subharmonics. Moreover, control of the subharmonic number is accomplished by varying the width of the noise pulses.

Figure 10:
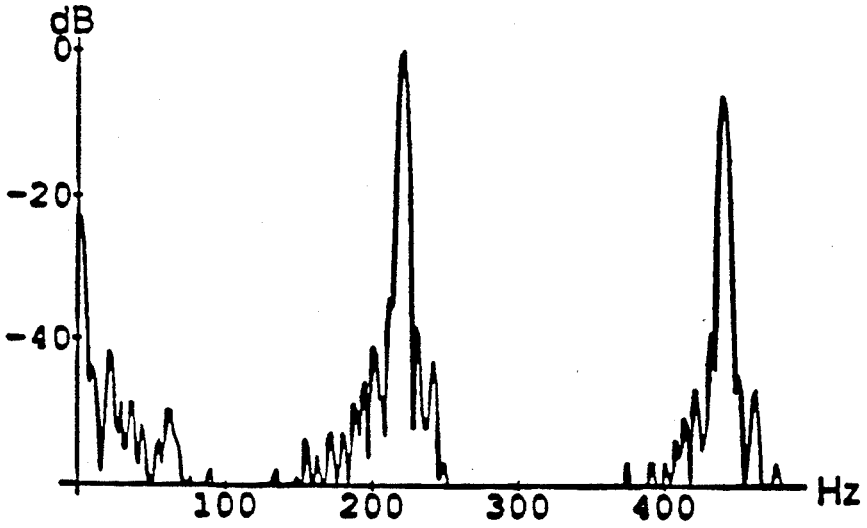
FIG. 10 depicts a discrete Fourier Transform of a simulated cello tone showing the first two harmonics of a 220 Hz tone.
Figure 11:
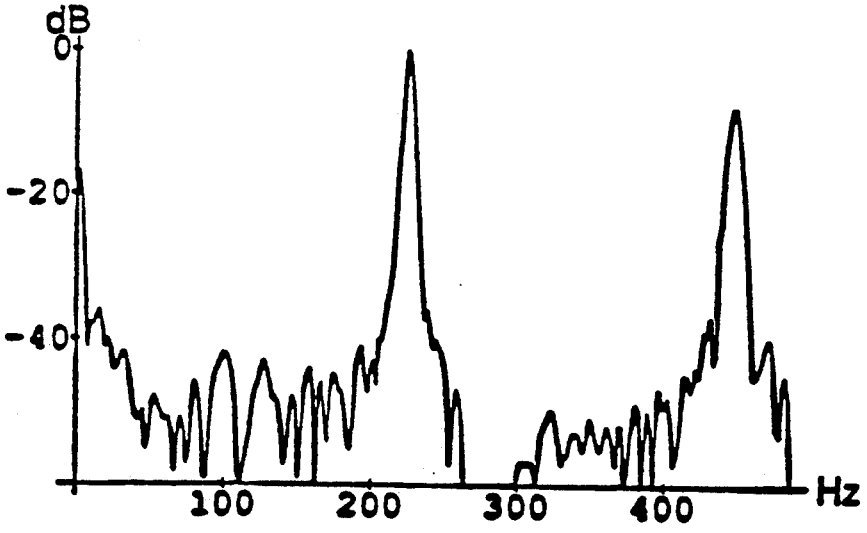
FIG. 11 depicts a discrete Fourier Transform of a simulated 220 Hz cello tone after the incorporation of noise generated in accordance with the present invention.

FIG. 10 depicts a discrete Fourier Transform of a simulated cello tone showing the first two harmonics of a 220 Hz tone. FIG. 11 depicts a discrete Fourier Transform of the same simulated 220 Hz cello tone after the incorporation of noise generated in accordance with the present invention. Subharmonic features generated by the incorporation of pulsed noise can be seen in FIG. 11 at −40dB in the vicinity of 100Hz. The most prominent peaks below the fundamental are possibly harmonics of very low subharmonics.

In simulations of the present invention, the synthesized noise is "well-incorporated" with the deterministic sounds generated by its period-synchronous timing, and perhaps by its influence on short-lived subharmonic features.

The supposition can be made that some subharmonic features are very short-lived. If so, it would seem that bow noise is implicated in causing micro-transients during sustained bowing and that the micro-transients give rise to subharmonic features in the waveform.

The inventor of the present invention believes that the present invention may also be applicable to voice synthesis, particularly the synthesis of voiced fricatives. This is because voiced fricatives, and possibly other vocal sounds, exhibit a pulsed noise component.

In conclusion, the present invention generates pulse modulated noise in a period synchronous manner so that the resulting noise is perceptually fused with the deterministic components of the synthesized sound. The present invention is practical for enhancing the naturalness of synthesized sounds. Changes in the noise sound follow in a predictable way control changes in the bowing, breath and embouchure parameters used in musical sound synthesis. The present invention is believed to be applicable to the synthesis and simulation of a wide range of non-percussive instruments.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A sound synthesizer, comprising:

control means for generating a frequency value;

deterministic signal generator means, coupled to said control means, for generating a first signal corresponding to said frequency value;

a noise generator for generating a noise signal which includes frequency components higher in frequency than said frequency value;

gating means, coupled to said control means, for periodically gating said noise signal at a frequency corresponding to said frequency value, with a duty cycle of less than 100 percent, so as to produce a pulsed noise signal which is period synchronous with said first signal; and means, coupled to said gating means and said deterministic signal generator means, for combining said first signal with said pulsed noise signal to produce an output signal.

2. A sound synthesizer as set forth in claim 1, wherein said pulsed noise signal includes a series of noise pulses having a specified pulse width, said gating means including pulse width control means for controlling the pulse width of said noise pulses in accordance with said specified pulse width.

3. A sound synthesizer, comprising:

means for generating a excitation signal;

resonating means for receiving an input signal and for generating a corresponding output signal;

noise generator means for generating a pulsed noise signal with a periodic, pulse-shaped amplitude envelope having a duty cycle of less than 100 percent; and means, coupled to said noise generator means and said resonating means, for combining said excitation signal with said pulsed noise signal to produce said input signal to said resonating means;

whereby said resonating means receives an input signal that includes said pulsed noise signal and generates a corresponding output signal.

4. A sound synthesizer, comprising:

control means for generating an excitation signal and a frequency value;

resonator means for receiving an input signal and for generating a corresponding output signal in accordance with said frequency value;

feedback means for combining said excitation signal with a portion of said musical output signal to produce a feedback signal;

non-linear means for performing a non-linear transformation of said feedback signal to produce a non-linear excitation signal;

a noise generator for generating a noise signal including frequency components higher in frequency than said frequency value, and for amplitude modulating said noise signal so as to generate a periodic, pulse-shaped amplitude envelope having a duty cycle of less than 100 percent and a period corresponding to said frequency value; and means, coupled to said noise generator means and said resonator means, for combining said non-linear excitation signal with said noise signal to produce said input signal to said resonator means;

whereby said output signal incorporates pulsed noise which is period synchronous with said first signal.

5. A method of synthesizing sounds, the steps of the method comprising:

generating a first signal corresponding to a specified frequency value;

generating a noise signal which includes frequency components higher in frequency than said frequency value;

gating said noise signal at a frequency corresponding to said frequency value, with a duty cycle of less than 100 percent, so as to produce a pulsed noise signal which is period synchronous with said first signal; and combining said first signal with said pulsed noise signal to produce an output signal.

6. A method of snythesizing sound as set forth in claim 5, wherein said pulsed noise signal includes a series of noise pulses having a specified pulse width, said gating step including the step of controlling the pulse width of said noise pulses in accordance with said specified pulse width.

7. A method of synthesizing sounds, the steps of the method comprising:

providing a resonating system which receives an input signal and generates a corresponding output signal in accordance with a specified frequency value;

generating a excitation signal;

generating a pulsed noise signal, including frequency components higher infrequency than said specified frequency value, said noise signal having a periodic, pulse-shaped amplitude envelope with a duty cycle of less than 100 percent and which is period synchronous with said output signal; and combining said excitation signal with said pulsed noise signal to produce said input signal to said resonating system;

whereby said resonating system receives an input signal that includes said pulsed noise signal and generates a corresponding output signal.

8. A method of synthesizing sounds, the steps of the method comprising:

generating an excitation signal and a frequency value;

providing an audio resonator which receives an input signal and generates a corresponding audio output signal in accordance with said frequency value;

combining said excitation signal with a portion of said audio output signal to produce a feedback signal;

performing a non-linear transformation of said feedback signal to produce a non-linear excitation signal;

generating a pulsed noise signal, including frequency components higher infrequency than said specified frequency value, said noise signal having a periodic, pulse-shaped amplitude envelope with a duty cycle of less than 100 percent and which is period synchronous with said output signal; and combining said non-linear excitation signal with said pulsed noise signal to produce said input signal to said audio resonator.

9. A sound synthesizer, comprising:

control means for generating a frequency value;

deterministic signal generator means, coupled to said control means, for generating a first signal corresponding to said frequency value;

a noise generator for generating a noise signal which includes frequency components higher in frequency than said frequency value;

modulating means, coupled to said control means, for amplitude modulating said noise signal with a periodic pulse-shaped envelope that is period synchronous with said first signal so as to produce a pulsed noise signal; and means, coupled to said modulating means and said deterministic signal generator means, for combining said first signal with said pulsed noise signal to produce an output signal.

* * * * *